US006206732B1

(12) United States Patent
Fukuda

(10) Patent No.: US 6,206,732 B1
(45) Date of Patent: Mar. 27, 2001

(54) ELECTRICAL CONNECTOR

(75) Inventor: Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/296,246

(22) Filed: Apr. 22, 1999

(30) Foreign Application Priority Data

Apr. 24, 1998 (JP) ..... 10-115007

(51) Int. Cl.[7] ..... H01R 24/00
(52) U.S. Cl. ..... 439/630; 439/839; 439/592
(58) Field of Search ..... 439/630, 635, 439/636, 637, 329, 557, 553, 592, 839

(56) References Cited

U.S. PATENT DOCUMENTS

| | | | | |
|---|---|---|---|---|
| 4,493,526 | * | 1/1985 | Masuda | 339/183 |
| 4,846,729 | * | 7/1989 | Hikami et al. | 439/161 |
| 5,203,725 | * | 4/1993 | Brunker et al. | 439/636 |
| 5,460,546 | * | 10/1995 | Kunishi et al. | 439/631 |
| 5,489,216 | * | 2/1996 | Matsushita et al. | 439/260 |
| 5,769,673 | * | 6/1998 | Ohta et al. | 439/852 |
| 5,975,946 | * | 11/1999 | Watanabe | 439/557 |

FOREIGN PATENT DOCUMENTS 42 40 547 C2 6/1993 (DE) .

OTHER PUBLICATIONS

Japanese U.M. Reg. Appln. laid–open No. 55–164783 published Nov. 26, 1999.
Japanese U.M. Reg. Appln. laid–open No. 57–136191 published Aug. 25, 1982.
Japanese U.M. Reg. Appln. laid–open No. 50–63593 published Jun. 10, 1975.

* cited by examiner

*Primary Examiner*—Michael L. Gellner
*Assistant Examiner*—Kyung S. Lee
(74) *Attorney, Agent, or Firm*—Armstrong, Westerman, Hattori, McLeland & Naughton

(57) ABSTRACT

The electrical connector includes a connector housing, at least one terminal, and an elastic member. The connector housing has at least one holder arm for receiving the terminal and has first and second insertion spaces. The terminal has an electrical contact portion that contacts a terminal connection portion of a circuit board. The elastic member is inserted into the second insertion space so as to push the holder arm toward the first insertion space against the deflection of the holder arm due to insertion of the circuit board. The first and second insertion spaces are defined to have the holder arm between within the connector housing. The electrical contact portion of the terminal can come into electrical contact with the terminal connection portion of the circuit board when the first insertion space has received the circuit board. The connector having such configuration can complement the terminal even if there is a warp or deformation in the circuit board.

10 Claims, 4 Drawing Sheets

ELECTRICAL CONNECTOR

BACKGROUND OF THE INVENTION

1. Field of the Invention

The present invention relates to an electrical connector, particularly to a connector including terminals that can be reliably electrically connected to associated terminals of a circuit board even when there is a warp in the circuit board.

2. Prior Art

Referring to FIGS. 5 and 6, denoted 1 is an electrical connector that is disclosed in Japanese Utility Model Application Laid-open No. 55-164783 by the same assignee as the present application. The connector 1 has a connector housing 2 made of synthetic resin and a plurality of receptacle terminals 3 inserted in the connector housing 2. The connector 1 is engageable with an instrument furnished case 5 that is made of synthetic resin and has a circuit board 4 such as a print circuit board.

The connector housing 2 has a plurality of receptacle terminal accommodating chambers 6 which are defined in upper and lower compartments in the connector housing 2. The connector housing 2 has an outer wall 7 formed with an arm 9 having a lock protrusion 8. In a forward part of the connector housing 2, there are provided side walls 10, 10 and an insertion space 12 that is defined so as to pass through partitions 11 separating the terminal accommodating chambers 6 for receiving the circuit board 4.

The receptacle terminal 3 has an electrical contact portion 13 and a wire connection portion 14 disposed adjacent to the electrical contact portion 13. The electrical contact portion 13 has a resilient contact piece 16 defined by a forward part of a base plate 15 thereof. The base plate 15 has locking holes 18 each engaged with one of lock protrusions 17 provided in the terminal accommodating chambers 6. Furthermore, the wire connection portion 14 is so configured as to crimp an electrical wire 19.

The circuit board 4 is provided with a plurality of short rectangular terminal connection portions 20 in the upper and rear faces thereof. Each terminal connection portion 20 is disposed so as to contact the resilient contact piece 16 of each receptacle terminal 3. The circuit board 4 is formed with a cutout 21 in its fore end.

The instrument furnished case 5 has a recess 22 for receiving a lower forward part of the connector housing 2. The recess 22 is formed with a lock opening 23 engageable with the lock protrusion 8 of the arm 9.

In the above-described prior-art, the connector 1 is electrically connected to the circuit board 4 and is removably attached to the instrument furnished case 5 with ease.

However, for example, if there is a warp or a deformation in the circuit board 4, the terminal connection portion 20 would not contact all the receptacle terminals 3 or would not obtain a sufficient contact force therebetween when the circuit board 4 is inserted in the connector housing 2. This is a disadvantage of the above-described prior art. The receptacle terminal 3 is made of an electrically conductive material so that it is difficult to keep enough resilience to complement the warp or deformation. Thus, the electrical connector 1 decreases in reliability of electrical connection.

In addition, if the receptacle terminal 3 is made of a material having a more reliable resilience, the receptacle terminal 3 may decrease in electrical conductivity.

SUMMARY OF THE INVENTION

In view of the above-described disadvantage, an object of the present invention is to provide an electrical connector that can complement a warp or deformation of an associated opposing circuit board to establish an improved electrical connection thereto.

For achieving the above-described object, in a first aspect of the present invention, an electrical connector includes a connector housing, at least one terminal, and an elastic member. The connector housing has a holder arm for receiving the terminal and has first and second insertion spaces therein. The terminal has an electrical contact portion that contacts a terminal connection portion of a circuit board. The elastic member is inserted into the second insertion space so as to exert a force on the holder arm toward the first insertion space against deflection of the holder arm due to insertion of the circuit board into the first insertion space.

The holder arm has a flexibility so as to deflect perpendicularly to the insertion direction of the circuit board. The first and second insertion spaces are separated by the holder arm inside an outer wall of the connector housing. The electrical contact portion of the terminal can come into electrical contact with the terminal connection portion of the circuit board when the first insertion space has received the circuit board.

The connector having such a configuration can complement the terminal even if there is a warp or deformation in the circuit board. That is, for example, when the circuit board warps at each end portion thereof to become an arc shape, the circuit board can exert a sufficient force on the holder arm by way of the terminal.

In such a state, a prior-art terminal having insufficient resilience would provide different contact forces against such a circuit board between at the middle part and at each side part thereof. In the present invention, the holder arm having the flexible holder arm is pushed by the elastic member to complement the terminal against the warp or deformation of the circuit board. This allows to maintain a sufficient contact force between the terminal and the circuit board.

Thus configured connector does not require a terminal having a higher resilience but allows a terminal having a sufficient electrical conductivity. This improves significantly the terminal in reliable electrical contact with the circuit board.

In a second aspect of the electrical connector as described in the first aspect, the electrical connector has a plurality of the holder arms each corresponding to each of a plurality of said terminals.

Thus defined holder arms each complement each terminal in respect of the warp or deformation of the circuit board. This accomplishes a secure contact force between each terminal and the circuit board.

In a third aspect of the electrical connector as described in the first aspect, the elastic member is a spring piece that is formed by bending a short rectangular strip at an intermediate portion thereof.

The elastic member is fabricated with a low cost and can be easily inserted and mounted in the connector housing.

In a fourth aspect of the electrical connector as described in the third aspect, the spring piece has a plurality of transversely spaced resilient fingers so that the elastic member may be mounted in the connector housing by a onetime minimum work.

In a fifth aspect of the electrical connector as described in the first aspect, the electrical contact portion of the terminal is formed in a resilient arc shape so as to deflect the holder arm toward the second insertion space.

The arc-shaped electrical contact portion of the terminal allows a better electrical contact with the circuit board. The elastic member can be determined with ease in resilience.

In a sixth aspect of the electrical connector as described in the first aspect, the connector housing has an outer wall provided with a resilient arm having a lock protrusion that can engage with a lock opening of an associated connector receiving recess.

The provision of the resilient arm having the lock protrusion assures connection between the connector and the circuit board side and also allows an easy disengagement thereof.

DETAILED DESCRIPTION OF THE PREFERRED EMBODIMENT

Referring to the accompanied drawings, an embodiment of the present invention will be discussed.

Figure 1:
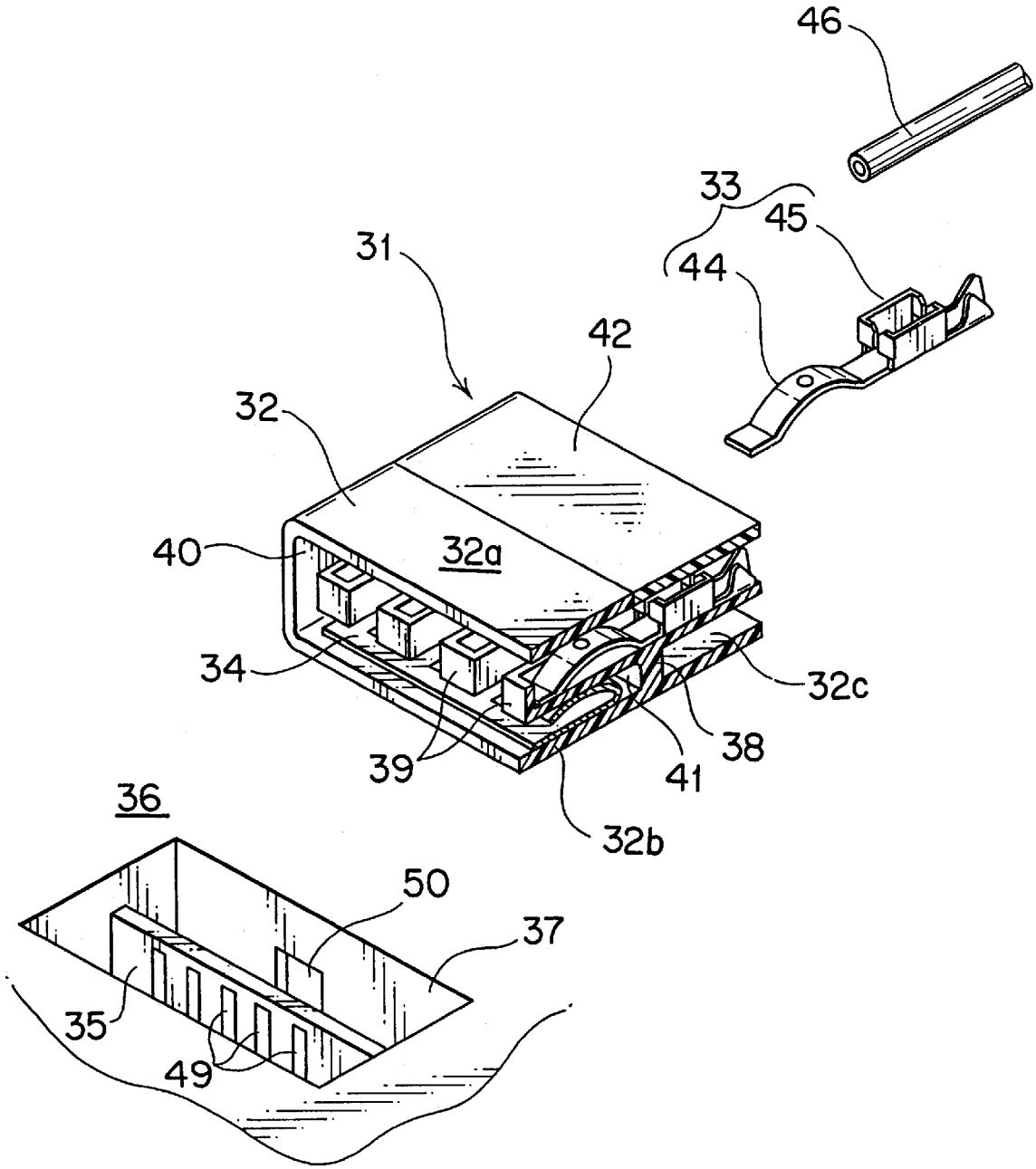
FIG. 1 is a perspective view showing an embodiment of an electrical connector according to the present invention.
Figure 2:
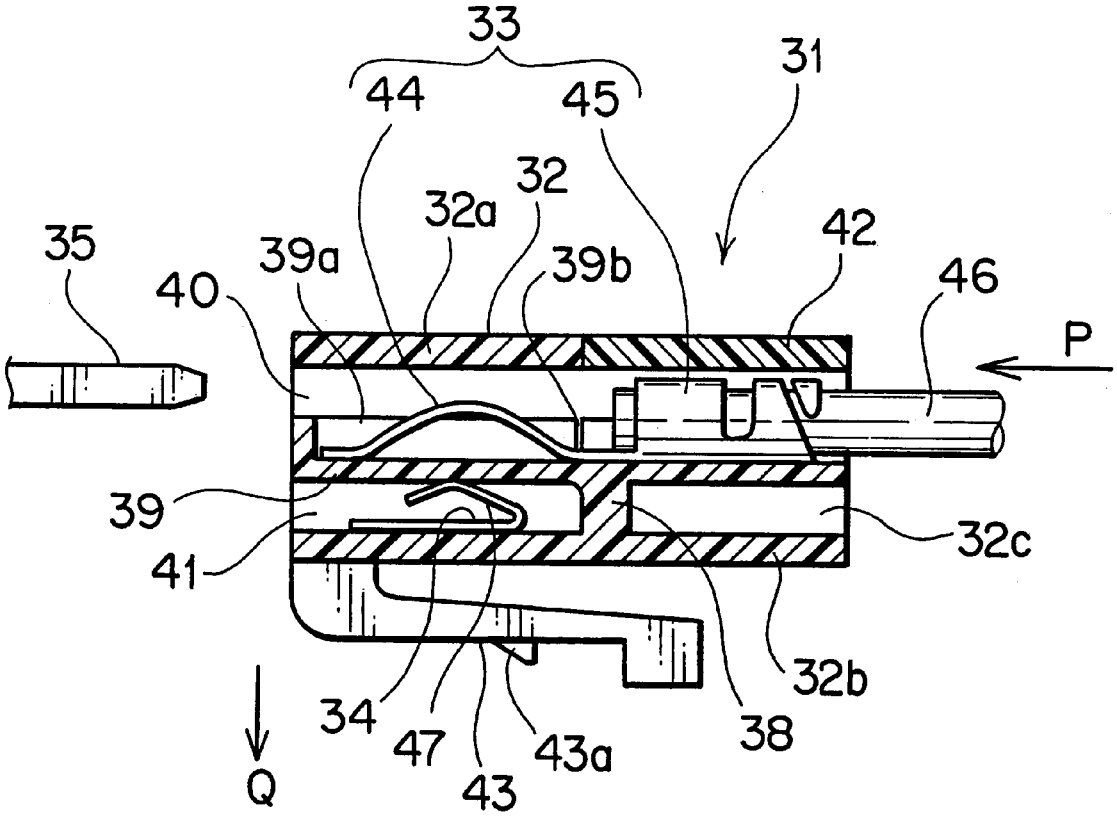
FIG. 2 is a longitudinal sectional view of the connector of FIG. 1.

In FIGS. 1 and 2, denoted 31 is an electrical connector used for an instrument furnished case which is a non-limiting example.

The connector 31 has a connector housing 32 made of synthetic resin, a plurality of receptacle terminals 33 that are formed by die-cut and bending from a stiff metal plate having a sufficient electrical conductivity such as phosphor bronze, and an elastic member 34 formed by die-cut and bending from a metal plate like a stainless steel to have a sufficient resilience. The connector 31 is inserted into a connector receiving portion 37 of an instrument furnished case 36, the portion 37 having a conductor disposed circuit board 35.

The connector housing 32 has a supporting wall 38 extending transversely so as to cross the connector housing 32 at the middle thereof. In an upper side of the supporting wall 38, there are provided a plurality of holder arms 39 in perpendicular to the supporting wall 38 for accommodating the receptacle terminals 33. Between an upper wall 32*a* and a lower wall 32*b* of the connector housing 32, there are provided an insertion space 40 (corresponding to the first insertion space described in the summary of the invention) for the conductor disposed board 35 and an insertion space 41 (corresponding to the second insertion space described in the summary of the invention) for the elastic member 34.

Denoted 32*c* is a hollow defined to have a suitable design of the connector housing 32.

The holder arm 39 has a shape like a rectangular cradle, which can receive each receptacle terminal 33 to lock it with a locking mean (not shown). Side walls 39*a* of the holder arm 39 each have a slit 39*b* near the supporting wall 38 (see FIG. 2) so that the holder arm 39 can deflect in direction Q perpendicular to the insertion direction P of the connector 31.

The insertion space 40 is extending rearward from a fore end of the connector housing 32 and faces each receptacle terminal 33. The insertion space 41 is extending from a fore end of the connector housing 32 to the supporting wall 38.

Meanwhile, in an upper rear half of the connector housing 32, there is provided a hollow (not shown) having a cover 42 attached to the connector housing 32. In addition, the lower wall 32*b* of the connector housing 32 has a resilient arm 43 provided with a lock protrusion 43*a* and extending from the fore end of the connector housing 32.

Each receptacle terminal 33 has an arc-shaped electrical contact portion 44 and a wire connection portion 45 joined to the electrical contact portion 44. The electrical contact portion 44 is a predetermined height, which provides a smaller gap between the electrical contact portion 44 and the upper wall 32*a* than the thickness of the conductor disposed board 35 when the receptacle terminal 33 has been received in the holder arm 39. Furthermore, the wire connection portion 45 is connected to an electrical wire 46 by crimping.

Figure 3:
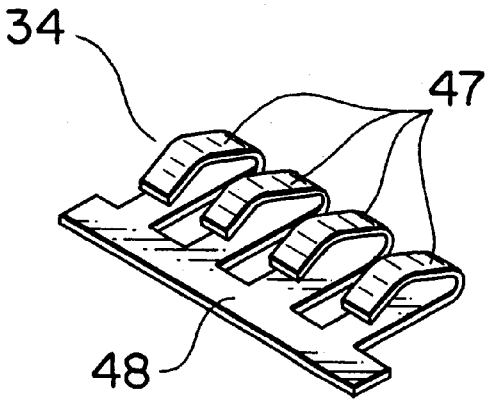
FIG. 3 is a perspective view showing the elastic member of FIG. 1.

The elastic member 34 has a plurality of spring pieces 47 each corresponding to one of the holder arms 39 as shown in FIG. 3. The spring pieces 47 are extending from a base portion 48 of the elastic member 34 to define transversely spaced fingers. Each spring piece 47 is formed by turning back an intermediate portion of a short rectangular strip from the base portion 48. The spring piece 47 is curved to protrude upward and has a height equal or slightly greater than the height of the insertion space 41.

Meanwhile, the conductor disposed board 35 shown in FIG. 1 has a terminal connection portion 49 consisting of a plurality of short rectangular printed conductors disposed on the upper and rear faces thereof. The terminal connection portion 49 contacts the electrical contact portion 44 of each receptacle terminal 33. The connector receiving portion 37 has a lock opening 50 engageable with the lock protrusion 43*a* of the arm 43.

Referring to FIGS. 1 and 2, steps of assembling the connector 31 and of inserting the connector 31 into the connector receiving portion 37 will be discussed.

First, in the assembling of the connector 31, each holder arm 39 of the connector housing 32 receives each receptacle terminal 33 inserted thereto. Next, the electrical wire 46 is crimped to the wire connection portion 45 and the cover 42 is mounted. Then, the insertion space 41 receives the elastic member 34 with the spring pieces 47 pointing inward, completing the assembling of the connector 31.

Then, the connector 31 is advanced in arrow P direction so that the connector 31 is inserted into the connector receiving portion 37, and also the insertion space 40 receives the conductor disposed board 35. Thereby, the conductor disposed board 35 abuts against the electrical contact portion 44. A further advancement of the connector 31 brings the arc-shaped electrical contact portion 44 in sliding contact with the conductor disposed board 35. The electrical contact portion 44 is urged to make the holder arm 39 deflect toward the insertion space 41 (i.e. in arrow Q direction).

The deflection of the holder arm 39 is moved backward by the spring force of the elastic member 34 inserted in the insertion space 41. This allows a stable contact force between the receptacle terminal 33 and the terminal connection portion 49.

Even where the conductor disposed board 35 has a warp or deformation, the holder arm 39 deflects along the warp when the board 35 is inserted into the connector 31 so that a sufficient electrical connection is established between the receptacle terminal 33 and the terminal connection portion 49.

Thus, the receptacle terminal 33 of the connector 31 does not require a high elasticity but may be made of a material having a better electrical conductivity, significantly improving electrical contact with the conductor disposed board 35 in reliability.

Figure 4:
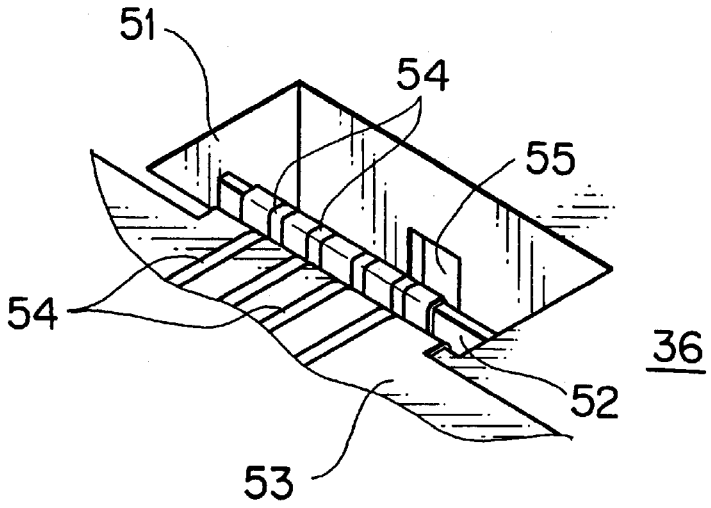
FIG. 4 is a perspective view showing a connector receiving portion different from one shown in FIG. 1.
Figure 6:
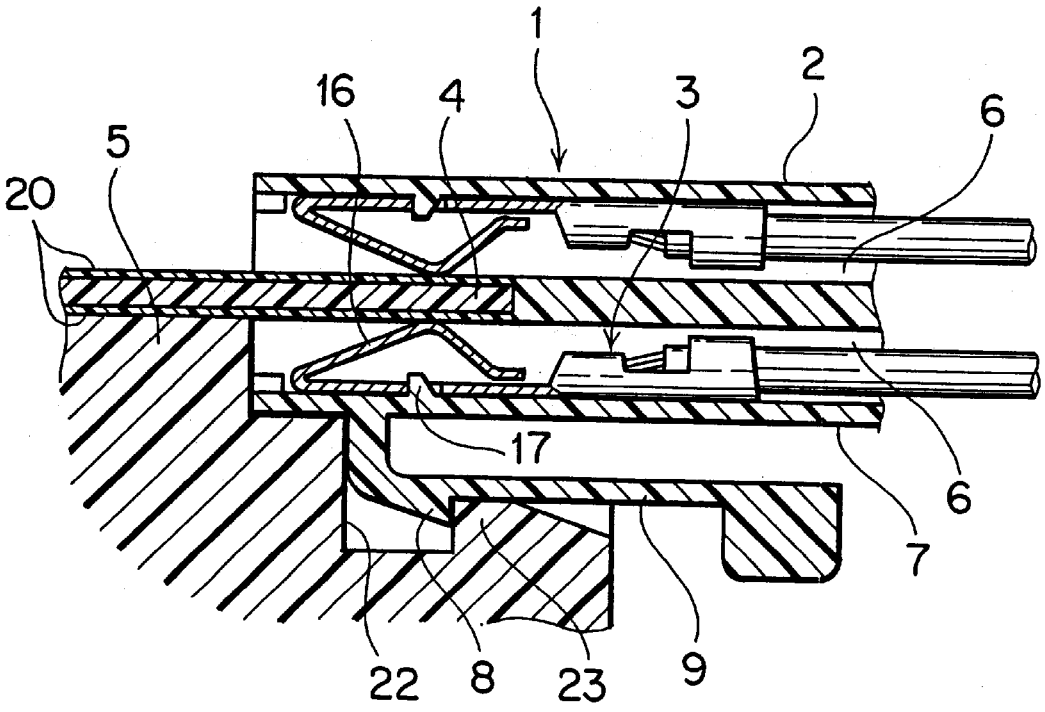
FIG. 6 PRIOR ART
FIG. 6 is a longitudinal sectional view of the connector of FIG. 5.
Figure 5:
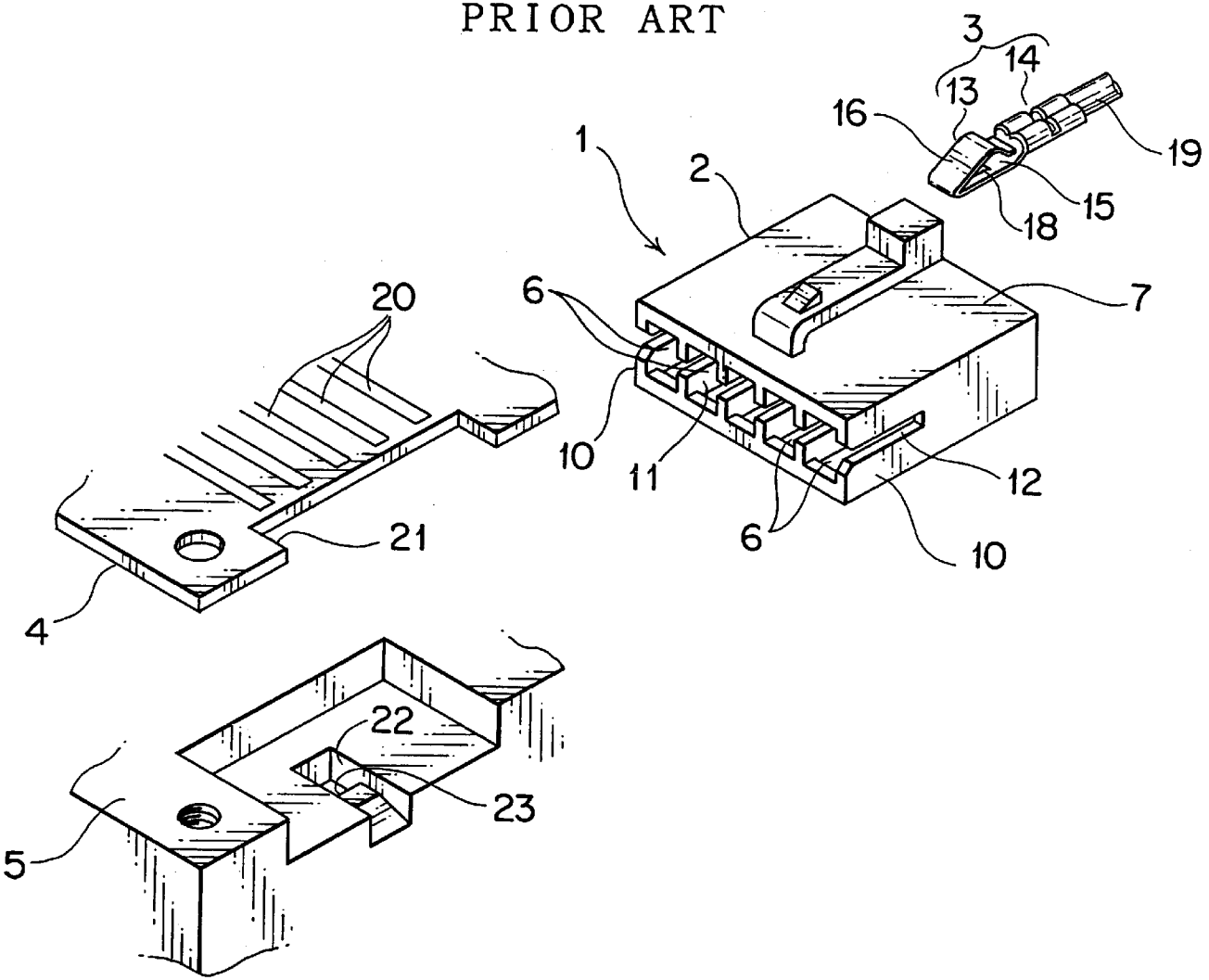
FIG. 5 PRIOR ART
FIG. 5 is a perspective view showing a prior-art electrical connector.

In addition, the connector 31 may be inserted into a connector receiving portion 51 shown in FIG. 4. The connector receiving portion 51 is made of synthetic resin and has a base board 52. The base board 52 has upper and rear faces fitted with a part of a flexible print circuit 53 received in the instrument furnished case 36. The flexible print circuit 53 includes a plurality of short rectangular terminal connection portions 54.

The connector receiving portion 51 is formed with a lock opening 55 engageable with the lock protrusion 43*a* of the arm 43.

Moreover, the present invention may be practically modified without departing from the essence thereof.

What is claimed is:

1. An electrical connector comprising:

a connector housing having first and second insertion spaces and at least one holder arm, the first insertion space being defined between an outer wall of said connector housing and one side of said holder arm, said second insertion space being defined between an outer wall of said connector housing and the opposite side of said holder arm, said holder arm being flexible to deflect toward said first and second insertion spaces, a terminal received in said holder arm so as to face to said first insertion space and having an electrical contact portion, and an elastic member inserted into said second insertion space, wherein said first insertion space can receive a circuit board having a terminal connection portion to electrically connect to the electrical contact portion of said terminal, and said elastic member can exert a force on said holder arm toward said first insertion space against deflection of said holder arm due to the insertion of said circuit board into said first insertion space.

2. The electrical connector as recited in claim 1, wherein said electrical connector has a plurality of said holder arms each receiving said terminal.

3. The electrical connector as recited in claim 2, wherein said elastic member is a spring piece which is formed by bending a short rectangular strip at an intermediate portion thereof.

4. The electrical connector as recited in claim 1, wherein said elastic member is a spring piece which is formed by bending a short rectangular strip at an intermediate portion thereof.

5. The electrical connector as recited in claim 1, wherein said electrical contact portion of said terminal is formed in an arc shape so as to deflect said holder arm toward said second insertion space.

6. The electrical connector as recited in claim 1, wherein said connector housing has an outer wall provided with a resilient arm having a lock protrusion that can engage with a lock opening of an associated connector receiving recess.

7. The electrical connector as recited in claim 1, wherein said holder arm is supported by a wall provided in said connector housing, the wall extending perpendicular to the insertion direction of said terminal.

8. The electrical connector as recited in claim 1, wherein said holder arm has a cradle shape for accommodating said terminal.

9. An electrical connector comprising:

a connector housing having first and second insertion spaces and at least one holder arm, the first insertion space being defined between an outer wall of said connector housing and one side of said holder arm, said second insertion space being defined between an outer wall of said connector housing and the opposite side of said holder arm, said holder arm being flexible to deflect toward said first and second insertion spaces, a terminal received in said holder arm so as to face toward said first insertion space and having an electrical contact portion, and an elastic member comprising a spring piece, formed by bending a short rectangular strip at an intermediate portion thereof, having a plurality of transversely spaced resilient fingers, inserted into said second insertion space, wherein said first insertion space can receive a circuit board having a terminal connection portion to electrically connect to the electrical contact portion of said terminal, and said elastic member can exert a force on said holder arm toward said first insertion space against deflection of said holder arm due to the insertion of said circuit board into said first insertion space.

10. An electrical connector comprising:

a connector housing having first and second insertion spaces and at least one holder arm, the first insertion space being defined between an outer wall of said connector housing and one side of said holder arm, said second insertion space being defined between an outer wall of said connector housing and the opposite side of said holder arm, said holder arm having a slit so as to be flexible to deflect toward said first and second insertion spaces, a terminal received in said holder arm so as to face toward said first insertion space and having an electrical contact portion, and an elastic member, having a plurality of transversely spaced resilient fingers, inserted into said second insertion space, wherein said first insertion space can receive a circuit board having a terminal connection portion to electrically connect to the electrical contact portion of said terminal, and said elastic member can exert a force on said holder arm toward said first insertion space against deflection of said holder arm due to the insertion of said circuit board into said first insertion space.

* * * * *